US007921605B2

(12) United States Patent
Jacobs et al.

(10) Patent No.: US 7,921,605 B2
(45) Date of Patent: Apr. 12, 2011

(54) ROOF STRUCTURE WITH SNOW GUARD AND METHOD OF INSTALLING

(75) Inventors: Gregory F. Jacobs, Oreland, PA (US); Robert L. Jenkins, Honey Brook, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 12/902,415

(22) Filed: Oct. 12, 2010

(65) Prior Publication Data

US 2011/0023380 A1 Feb. 3, 2011

Related U.S. Application Data

(63) Continuation of application No. 12/055,464, filed on Mar. 26, 2008.

(51) Int. Cl.
*E04D 13/00* (2006.01)

(52) U.S. Cl. ..... 52/26; 52/748.1

(58) Field of Classification Search ..... 52/24, 26, 52/748.1

See application file for complete search history.

(56) References Cited

U.S. PATENT DOCUMENTS

| | | | |
|---|---|---|---|
| 463,235 | A | 11/1891 | Reimel |
| 625,144 | A | 5/1899 | Clark |
| 654,438 | A | 7/1900 | Clark |
| 834,081 | A | 10/1906 | Sieger |
| 1,463,065 | A | 7/1923 | Sieger |
| 1,475,931 | A | 12/1923 | Cambell |
| 1,530,233 | A | 3/1925 | Cambell |
| 1,647,345 | A | 11/1927 | Douglas |
| 1,863,561 | A | 6/1932 | Brinker et al. |
| 3,296,750 | A | 1/1967 | Zaleski |
| 3,305,980 | A | 2/1967 | Locker |
| 3,373,532 | A | 3/1968 | Strange |

(Continued)

FOREIGN PATENT DOCUMENTS

EP 1201844 B1 10/2010

*Primary Examiner* — Brian E Glessner
*Assistant Examiner* — Beth Stephan
(74) *Attorney, Agent, or Firm* — Paul & Paul

(57) ABSTRACT

A roof structure and a method of installing a snow guard on the base of a roof is provided, wherein the roof structure includes a plurality of synthetic shingles of thermoplastic materials, and where a snow guard is provided having an outwardly projecting snow-engaging platform and an oppositely provided hook at an upper end, wherein the hook is adapted to engage over and upper edge of a butt portion of one or more shingles in an underlying course of shingles, and wherein a tab portion of a shingle in a next-overlying course of shingles is disposed over the upper end of the snow guard, substantially covering its base, and wherein the snow-engaging platform is adapted to receive snow and ice that may slide down the roof, to intercept the same or break the snow or ice up into small harmless particles. The synthetic shingles of thermoplastic materials allow for the upward bending of the overlying tab portions of shingles a substantial amount within their elastic limit, to permit insertion of snow guards under tab portions of overlying shingles, where such tab portions of overlying shingles are already-installed on a roof, followed by a relaxation of the upwardly bent tab portions of shingles back to a flattened condition overlying the butt portions of shingles in an underlying course of shingles, and overlying the base of the snow guard between the platform and hook, due to the inherent memory of the original flattened shape of the shingles that have their tab portions flexibly upwardly bent.

20 Claims, 7 Drawing Sheets

U.S. PATENT DOCUMENTS

| | | | |
|---|---|---|---|
| 5,343,659 | A | 9/1994 | Zaleski |
| 5,371,979 | A | 12/1994 | Kwiatkowski et al. |
| 5,615,523 | A | 4/1997 | Wells et al. |
| 5,630,305 | A | 5/1997 | Hlasnicek |
| 5,635,125 | A | 6/1997 | Ternes et al. |
| 5,655,334 | A | 8/1997 | Kwiatkowski |
| 5,664,374 | A | 9/1997 | Lee |
| 5,669,184 | A | 9/1997 | Anderson |
| 5,711,114 | A | 1/1998 | Mueller |
| 5,943,826 | A | 8/1999 | Totin |
| 6,070,368 | A | 6/2000 | Anderson |
| 6,290,885 | B1 | 9/2001 | Roetheli et al. |
| 7,178,301 | B2 | 2/2007 | Albright |
| 7,520,098 | B1 | 4/2009 | Martinique et al. |
| 2003/0121228 | A1 | 7/2003 | Stoehr et al. |

ROOF STRUCTURE WITH SNOW GUARD AND METHOD OF INSTALLING

CROSS-REFERENCE TO RELATED APPLICATION

This is a Continuation of U.S. application Ser. No. 12/055,464, filed Mar. 26, 2008.

BACKGROUND OF THE INVENTION

It is known to use snow guards on roof structures, particularity in northern climates, where the weather conditions are such that snow and/or ice accumulates on roofs. Snow guards are used, most particularly when the roofs are steeply sloped, to provide protrusions or outwardly extending platforms that protrude outwardly and upwardly, generally perpendicular to the slope of the roof, to engage snow or ice that may accumulate on the roof, to keep sheets of snow or ice from sliding down the roof, off the roof, possibly causing damage to people, shrubs, etc.

Typically, snow guards have, in addition to the protrusion or platform, a base that is disposed between underlying and overlying shingles on the roof. It is generally known that in colder climate conditions, snow guards are installed as the roof is built up, being placed over an underlying shingle or shingles in a course, prior to installing the next-overlying shingle in its overlying course.

Most particularly, it is known that snow guards are desirable on steeply sloped roofs wherein the shingles on the roof are of natural slate or natural tile, being made of materials that are very rigid, often having outer weather-engaging surfaces that can be smooth, allowing snow or ice that accumulates on the outer surfaces of such shingles or tiles to slide downwardly along the highly sloped surface of the roof, most particularly as the snow or ice begins to thaw, with the protrusions or platforms of the snow guards engaging the snow or ice and breaking up large sheets of the same into smaller, generally harmless pieces of snow or ice not readily capable of causing damage to personnel, plants, bushes, etc.

Where a roof is made up of naturally occurring materials, such as slate, shake or tile, it is known to install snow guards as the roof is being laid up, on top of courses of such roof materials that have already been applied, prior to applying an overlying course of such rigid slate, shake, or tile shingles thereover. However, in the case of an already-installed roof of rigid natural slate, shake, or tile shingles, if snow guards are later desired to be installed, it can become necessary to remove some shingles of slate, shake, or tile construction so that the same can be lifted upwardly an amount to install snow guards therebeneath, between shingles in two underlying-overlying courses. Where such slate, shake, or tile shingles of natural materials are rigid, they can break as they are being lifted upwardly. In the absence of breaking it becomes necessary to remove the nails or fasteners for such shingles an amount sufficient to raise such shingles upwardly to enable placement of a snow guard therebeneath, and then to re-fasten such rigid naturally occurring shingles back down to the roof.

THE PRESENT INVENTION

The present invention is directed to providing snow guards for use with synthetic, generally thermoplastic materials that are either being installed on a roof, or when already-installed on a roof, such that the shingles are made so that they can be flexibly bent upwardly an amount within their elastic limit to permit insertion of snow guards under tab portions of shingles, wherein the snow guards have hooks thereon that engage behind shingles in a next-underlying course, and with the shingles that have been lifted upwardly, flexibly bent within their elastic limit, being then allowed to return to their original generally planar configuration, back down over the snow guard, leaving a protruding or platform portion of the snow guard disposed beneath the shingle, the tab portion of which had been flexibly bent upwardly.

Accordingly, it is an object of this invention to provide a roof structure comprised of a roof base, synthetic shingles of thermoplastic material, and snow guards having hooks at their upper ends and protruding portions, such as platform portions protruding outwardly at their lower ends, beyond the shingled roof in the installed condition, wherein the shingles are sufficiently resiliently flexible to allow the snow guards to be inserted between overlying and underlying shingles after the shingles have been installed on a roof, without breakage of the shingles and without requiring partial or full removal of fasteners holding such shingles to the roof.

It us a further object of this invention to provide a method of installing snow guards on a roof, consistent with the roof structure described above.

It is yet another object of this invention to provide a roof structure and a method of installing snow guards on a roof structure, wherein the resilient flexibility of the synthetic shingle is sufficient to permit installing the snow guards with their protruding platforms temporarily beneath the uplifted roof shingles, so that downwardly and rearwardly facing hooks of the snow guards can engage over upper edges of next-underlying shingles in a course, and then to slide the roof guards downwardly, parallel to the slope of the roof out beyond the lower edge of an upwardly lifted synthetic shingle, allowing the shingle to return to its original position flat against the underlying shingle or shingles on a roof, and overlying a base portion of the snow guard that connects the hook and the outwardly protruding platform portion thereof, such that the platform portion of the snow guard engages at or below the lower edge of the temporarily upwardly bent shingle after that shingle is returned to its original position.

It is another object of this invention to provide snow guards with hooks that have beveled edges, either inwardly beveled, or outwardly beveled in the hook portion.

It is yet a further object of this invention to provide snow guards for installation as described above, wherein the hooks are adapted to be resiliently or springingly engaged behind one or more shingles in a next-underlying course, when the snow guards are installed.

It is a further object of this invention that the synthetic shingles have tracks or ribs on their rear surfaces for allowing sliding movement of snow guards that are being applied, upwardly along a said track, and that after the shingles are installed, the tracks can function to inhibit lateral movement of snow guards relative to overlying shingles.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

Figure 1:
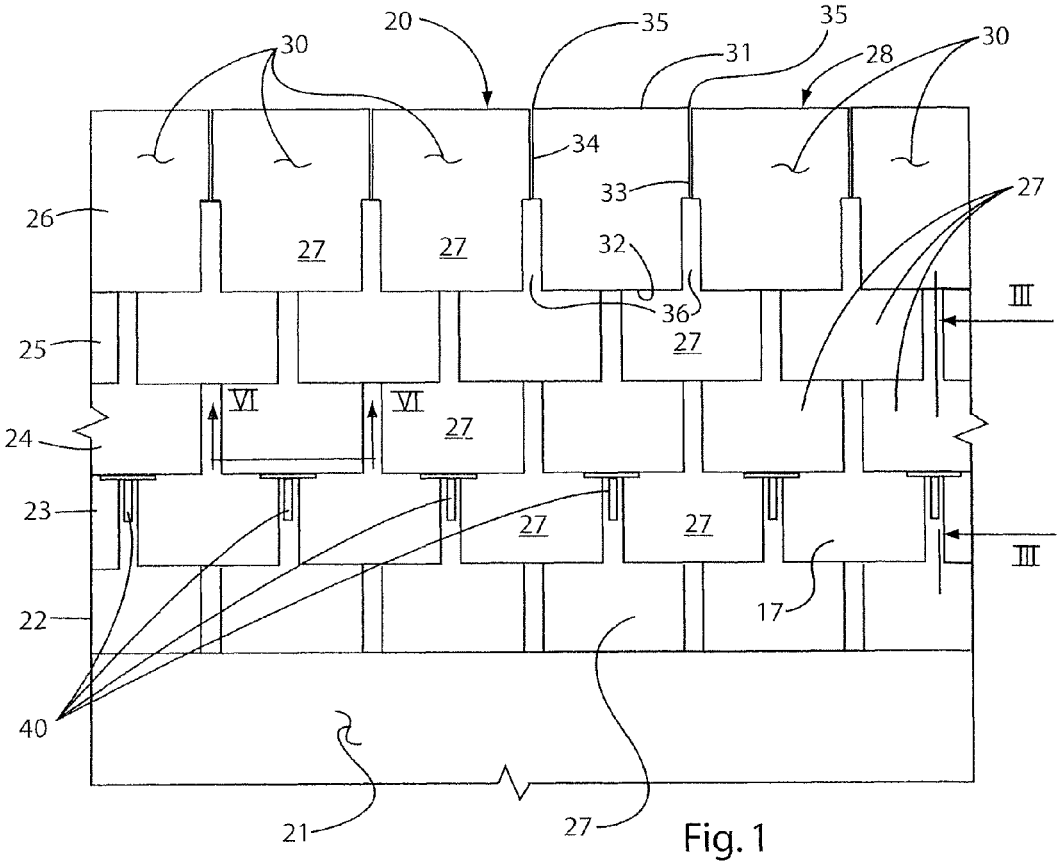
FIG. 1 is a plan view of a sloped roof having a plurality of courses of synthetic shingles of thermoplastic materials applied thereto, with the roof being fragmentally illustrated, and wherein snow guards are shown with their platforms disposed below lower edges of applied shingles.
Figure 2:
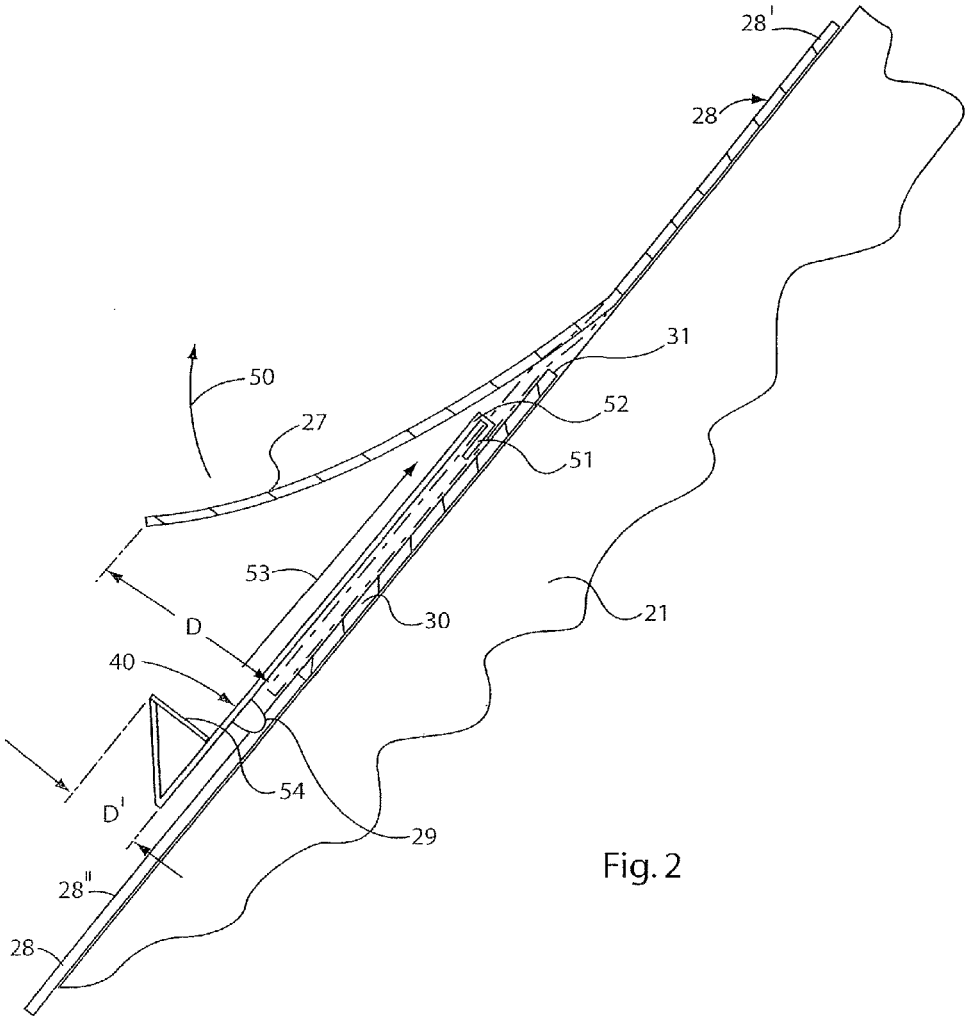

FIG. 2 is an enlarged fragmentary side elevational view of a portion of the roof of FIG. 1, taken generally along the line III-III, showing an upwardly lifted synthetic thermoplastic shingle, that is flexibly bent upwardly an amount within its elastic limit, to permit insertion of a snow guard thereunder, with the snow guard to be slid upwardly beneath the shingle while overlying a shingle in a lower course.

Figure 3:
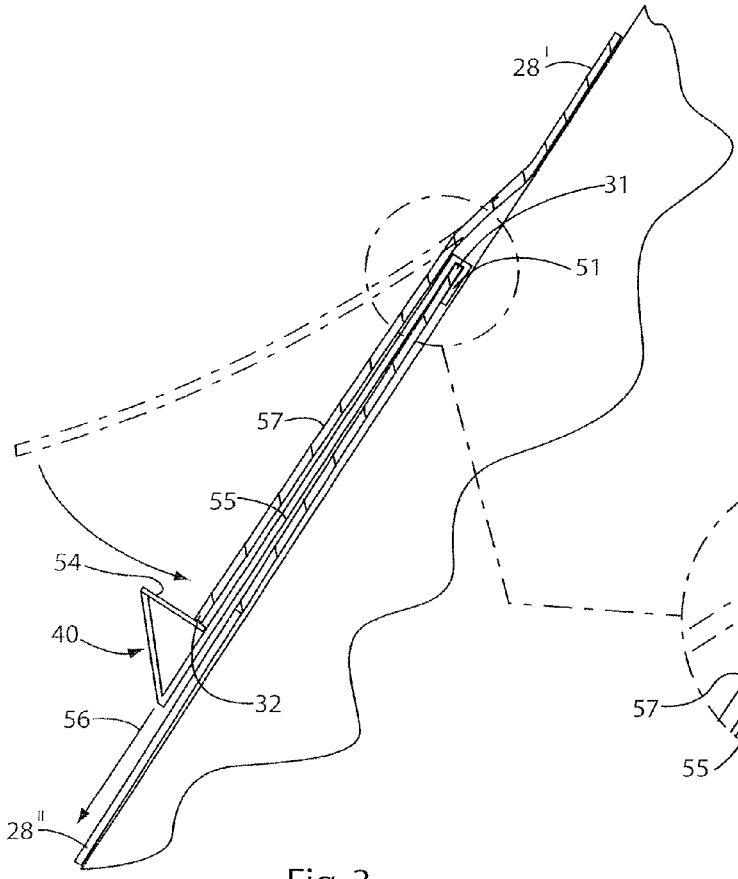

FIG. 3 is an illustration similar to that of FIG. 2, also taken generally along the line III-III of FIG. 1, but wherein the upwardly lifted, flexibly bent overlying shingle, shown in phantom, has been allowed to return to its original flattened position against the roof, sandwiching a base portion of the snow guard therebetween, and wherein the snow guard has had its hook at its upper end slid downwardly to engage behind the upper edge of an underlying shingle, and with the snow guard then being pulled downwardly to allow complete return of the overlying shingle against the base of the snow guard, and above the outwardly protruding platform thereof.

Figure 3A:
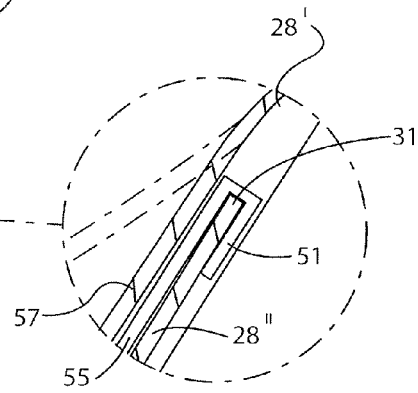

FIG. 3A is an enlarged detailed view of a portion of FIG. 3, showing more clearly the engagement of the hook of the snow guard beneath the upper end of a butt portion of a shingle in a next-underlying course.

Figure 4:
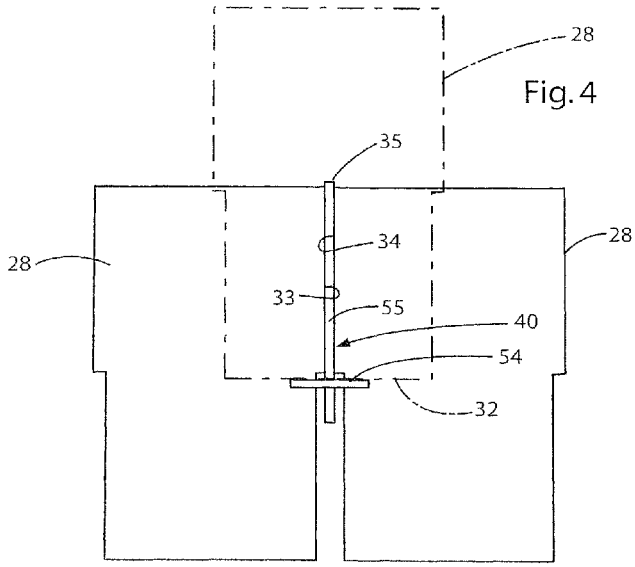

FIG. 4 illustrates a pair of synthetic shingles of thermoplastic material in accordance with this invention, arranged side-by-side in a given course, and with a snow guard installed therebetween, between opposing side edges of butt portions of the shingle, and with a next-overlying shingle being shown in phantom thereover, such that the snow guard itself may be seen in the installed condition, with greater clarity.

Figure 5:
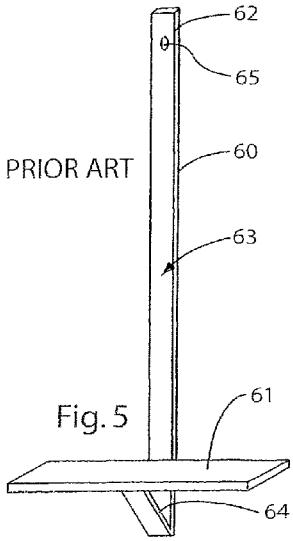

FIG. 5 is an illustration of a prior art type of snow guard, having a straight upper end, to receive a fastener therein, and it is the type of a snow guard that can be used on a roof as a roof is being installed, to be fastened over a next-underlying shingle in a given course, prior to installation of a next-overlying course of shingles, wherein the shingles that are used with the type of snow guard of FIG. 5, are generally very rigid, being constructed of naturally occurring materials such as slate, shake, or tile, that are not flexibly bendable within their elastic limit either at all, or at least not an amount sufficient to install the snow guard of FIG. 5 after the roof is installed.

Figure 5A:
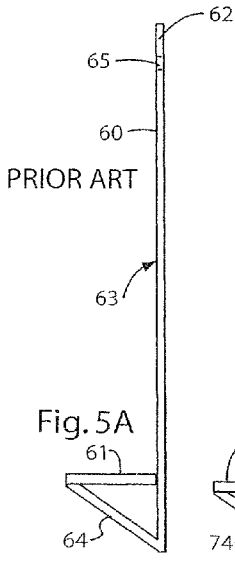

FIG. 5A is a side elevational view of the shingle of FIG. 5.

Figure 5B:
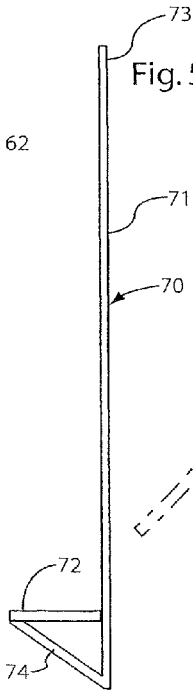

FIG. 5B is an illustration of a snow guard made in accordance with this invention, prior to bending the upper end of the snow guard into a hook formation prior to installing it with a hook behind a next-underlying shingle, in accordance with this invention.

Figure 5C:
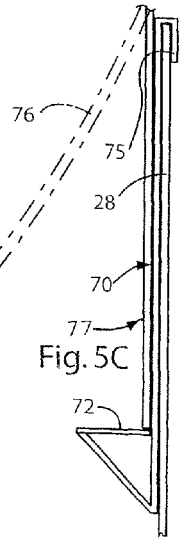

FIG. 5C is a side elevational view of the snow guard of FIG. 5B, after the upper end of the snow guard is bent into a hook configuration, and with the hook configuration shown in engagement behind a next-underlying shingle on a roof, and wherein the next-overlying flexibly bent tab portion of the shingle is shown in phantom and in full line positions, illustrating, respectively, the upward bend of the relatively flexible portion of a shingle in accordance with this invention, and its return to its permanent position overlying the base of the snow guard.

FIGS. 5D, 5E, 5F, 5G, 5H and 5I are fragmentary portions of upper ends of snow guards for use in accordance with the present invention, whereby various bevels, bends and constructions for facilitating engagement of the upper ends of snow guards behind upper ends of butt portions of next-underlying shingles in a course are illustrated, as will be described in more detail hereinafter.

Figure 6:
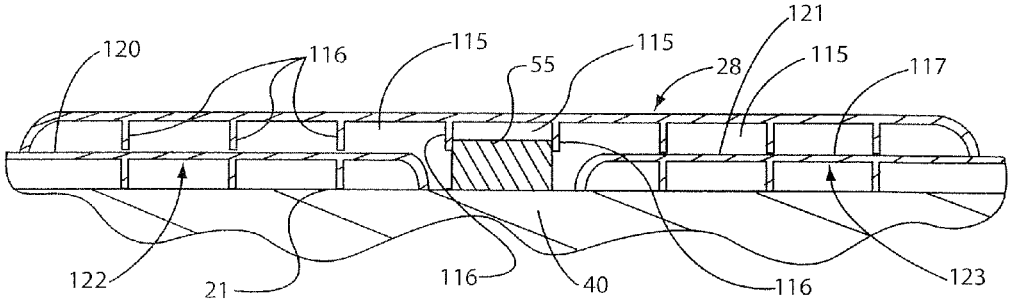

FIG. 6 is a generally vertical section, taken through shingles and a snow guard in accordance with this invention, generally along the line VI-VI of FIG. 1, and wherein a fragmentary portion of a roof, with shingles thereon are shown fragmentally and with a snow guard installed in a track between ribs of a next-overlying shingle in accordance with this invention, are clearly illustrated.

DETAILED DESCRIPTION OF PREFERRED EMBODIMENTS

Referring now to FIG. 1 in detail, it will be see that a roof structure is illustrated, generally designated by the numeral 20, with the structure comprising a fragmentary portion of a roof base 21, steeply sloped as will be seen hereafter with reference to FIGS. 2 and 3, with a plurality of courses of synthetic shingles of thermoplastic materials applied thereto, with each course such as those 22, 23, 24, 25 and 26 being applied such that tab portions 27 of shingles, all generally identified by the numeral 28 in FIG. 1, are shown in overlying relation to butt portions 30 of underlying shingles.

The thermoplastic shingles 28 are each preferably constructed of a thermoplastic resin material which may or may not have fillers therein, and which may or may not have reinforcement materials therein, such as lengths of fiber, for additional strength. The shingles 28 will also preferably be molded or shaped to simulate natural slate, tile or shake materials that are generally not flexible, although the shingles 28, while simulating natural materials, will have sufficient flexibility that they can be upwardly, flexibly bent an amount within their elastic limit to permit insertion of snow guards therebeneath, and allow for retraction to their original, generally flattened or original configurations that existed prior to being flexibly bent upwardly, after the upward force that flexibly bends them is removed.

The synthetic shingles may, if desired have separate materials for their core and capstock (outer, weather exposed portions, if desired).

Each shingle 28 has an upper edge 31, a lower edge 32, a right edge 33, and a left edge 34. Right and left edges of adjacent shingles may be slightly spaced apart as shown at 35, between their butt portions 30. The shingles 28 may also have slots 36 between their right and left edges of their tab portions when the shingles 28 are disposed adjacent each other, as shown in FIG. 1. A plurality of snow guards 40 are shown between adjacent ones of the shingles.

Figure 1A:
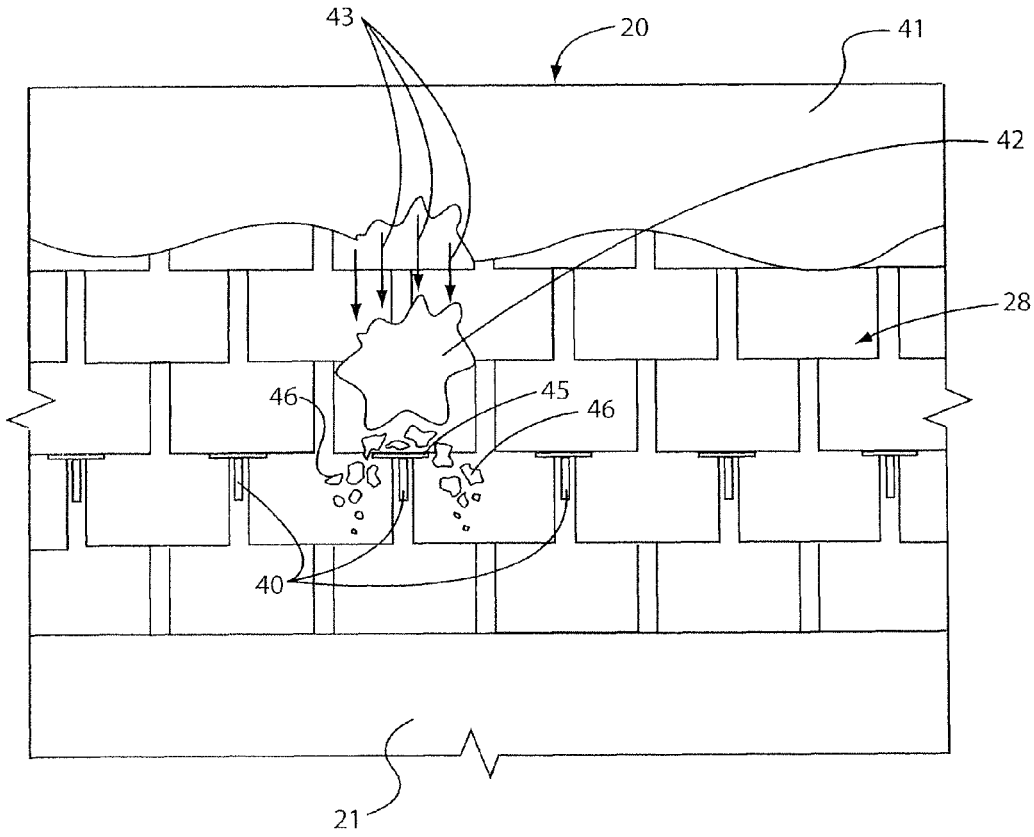
FIG. 1A is an illustration similar to that of FIG. 1, but wherein it is illustrated how snow or ice, when sliding downwardly along the highly sloped roof surface, can engage against outwardly protruding platforms of snow guards, and become broken-up into smaller, harmless pieces.

With reference now to FIG. 1A, it will be seen that, as snow or ice 41 accumulated on the roof 20 begins to break apart, large pieces, clumps or sheets 42 thereof may break away, falling therefrom, as shown by the arrows 43 in FIG. 1A, downwardly, to engage platform or protrusion portions 45 of the snow guards 40 as shown in FIG. 1A, whereby the pieces, clumps or sheets 42 of snow or ice are broken up into smaller pieces or particles 46 as shown, which can then fall downwardly off the lower end of the roof, without damaging people, plants or shrubs.

With respect to the enlarged fragmentary illustration of FIG. 2, it will be noted that the roof base 21 is illustrated, as having shingles 28 in an overlying course, with their tabs portions 27 overlying butt portions of shingles 28 in an underlying course.

For ready reference, the illustrated shingle in FIG. 2 that is in an overlying course is indicated as shingle 28', and the shingle in the underlying course is denominated shingle 28".

As shown in FIG. 2, the shingle 28' has its tab portion lifted arcuately upwardly, being flexibly bent, as shown, in the direction of the arrow 50, such that the tabs portion of the shingle 28' is moved from the phantom line position 28''' therefor, to the full line position, therefor, as shown in FIG. 2.

With the shingle 28' flexibly bent upwardly as shown in FIG. 2, the snow guard 40 can be moved from its full line position therefor shown in FIG. 2, to be slid upwardly beneath the flexibly upwardly bent tab portion 27 for the shingle 28' such that the downwardly bent hook 51 of the upper end 52 of the snow guard 40 can be moved upwardly in the direction of the arrow 53, overlying the butt portion of the shingle 28", to engage behind the upper edges 31 of two adjacent shingles 28" (as shown in FIG. 3). It will be noted that, in some embodiments, the amount "D" of upward bend for the shingle 28' as shown in FIG. 2 in the direction of the arrow 50 is greater than the dimension D' shown in FIG. 2, for the outward protrusion of the platform portion 54 of the snow guard 40, to allow for movement of the snow guard 40 upwardly in the direction of the arrow 53 an amount that the platform portion 54 of the snow guard 40 can be beneath the upwardly bent portion of the shingle 28. The snow guard 40 has an optional protuberance 29 extending between spaced apart opposing edges of tab portions of underlying shingles, as shown, which can effectively inhibit lateral movement leftward and rightward of installed snow guards.

With reference now to FIG. 3, it will be seen that the hook 51 of the snow guard 40 is in place, beyond and around the upper edges 31 of the butt portions of the underlying shingles 28", and that the snow guard 40, with its base 55 that connects the hook portion 51 and platform portion 54 has now been slid vertically downwardly in the direction of the arrow 56, such that the outwardly protruding platform portion 54 is now at a sufficiently low level with the hook 51 engaged over the upper edges 31 of the shingles 28", such that the upwardly flexibly bent tab portion of the overlying shingle 28' that is shown in phantom in FIG. 3 can now be allowed to return downwardly into an overlying full line position therefor, shown at 57, overlying the snow guard base 55 and overlying the butt portions of shingles 28", such that, due to its inherent memory, the upwardly flexibly bent tab portion of the shingle 28' also overlies the butt portions of the underlying shingles 28", with the lower edge 32 of the shingle 28' disposed just above the platform 54 of the snow guard 40 as shown.

In cold weather conditions, or whenever shingles 28 become somewhat brittle, an application of heat via a blow dryer or some other heating device may be helpful to make the resilient shingle more flexible, so that cracking of the shingle is avoided when the shingles are upwardly bent for installation of snow guards.

With respect to FIG. 3A, the detail enlargement shows more clearly that the hook 51 is disposed behind the upper edges 31 of the butt portions of the shingles 28, as is the return to flattened position of tab portion 57 of the overlying shingle via inherent memory of the tab portion 57 of the overlying shingle 28'.

Referring to FIG. 4 in detail, it will be seen that a pair of side-by-side adjacent shingles 28 are illustrated in the same course, with the base 55 of a snow guard disposed between opposed side edges 33, 34 of the shingles 28, in the space 35 between those shingles, and with the snow-engaging platform portion 54 of the snow guard 40 being disposed immediately beneath and substantially adjacent to a lower edge 32 of a next-overlying shingle 28, shown in phantom, so that it can be seen how the base 55 of the snow guard 40 extends between right and left edges of butt portions of adjacent shingles, so that the adjacent shingles 28 can inhibit lateral movement leftward and rightward, of installed snow guards, when the installed snow guards are in their installed position as shown in FIG. 4. Alternatively, the base 55 of a snow guard can overly the butt portions of the shingles 28, overlying the side edges 33, 34 thereof.

With reference now with FIG. 5 and FIG. 5A, a prior art type of snow guard 63 is illustrated, with a projecting platform portion 61, connected to an upper end 62 thereof, by a base 60. The base 60 also carries an angular support 64, for supporting the platform portion, as shown, as does the snow guard of the present invention.

However, at the upper end 62 of the snow guard 63, there is shown a nail or other fastener hole 65 for fastening the snow guard 63 over an underlying course of shingles, when shingles of a very rigid type, such as natural slate, shake or tile that are being applied to a roof (not shown). In such types of installations, the base 60 overlies a shingle lying therebeneath or extends between adjacent shingles in a course, and the upper end is secured to the base roof surface by means of nails or other fasteners applied through holes 65 in the snow guard base 60, such that the snow guard 63, as a practical matter, can only be installed during the original installation of rigid, non-flexible shingles of such natural materials or rigid synthetic materials resembling natural materials.

With reference now to FIG. 5B, a snow guard 70 is illustrated, having a base 71 connecting the platform portion 72 thereof to the upper end 73 of the snow guard 70, with an angular support 74 also provided. However, with the snow guard of FIG. 5 B, the upper end is sufficiently long that it can be reversely bent back on itself, as shown in FIG. 5C to provide a hook 75 to be disposed over the upper end of a shingle 28, as shown, when a tab portion 76 of a next-overlying shingle that has been resiliently upwardly bent within its elastic limit as shown in phantom in FIG. 5C, to allow the insertion of the snow guard 70 therebeneath, as is discussed above with reference to FIGS. 2, 3 and 3A, after which the upwardly bent portion 76, shown in phantom, is allowed to relax into a position overlying the snow guard, as shown by the full line illustration 77 of the tab portion of the overlying shingle.

With reference now to FIGS. 5D, 5E, 5F, 5G, 5H and 5I, a plurality of alternative embodiments for the hook portion of each of the snow guards of the present invention will now be illustrated.

Figure 5D:
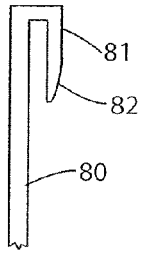

In FIG. 5D, the snow guard 80 has a hook 81 that has a bevel 82 on the right end of the hook 71 of the snow guard, for facilitating and sliding of the same behind a next-underlying shingle, or plurality of shingles, in a course.

Figure 5E:
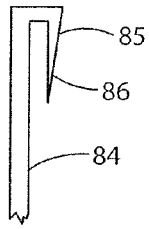

In FIG. 5E, a snow guard 84 is shown with its hook 85 also having a bevel 86 on its outer end, cut more pointedly than that shown in FIG. 5D, but otherwise functioning similarly thereto, when installed behind the upper edge of a next-underlying shingle.

Figure 5F:
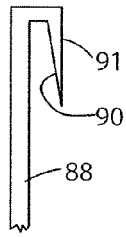

In FIG. 5F, a snow guard 88 has a bevel 90 on the inside of the hook 91, also to facilitate its disposition behind the upper end of a next-underlying shingle to facilitate sliding of the same behind a perhaps somewhat thicker shingle.

Figure 5G:
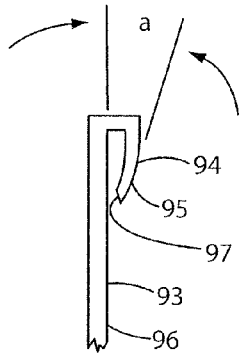

With respect to FIG. 5G, the upper end of a snow guard 93 is shown, with its hook 94 being arcuately bent, and having a lower portion 95 thereof that is at an angle "a", as shown, to the upstanding surface 96 of the rear of the base portion of the snow guard 93, such that the edge 97 of the hook 94 may frictionally engage behind the next-underlying shingle, over which the hook of the snow guard 93 is installed, for secure, frictionally-engaged fastening of the hook behind that shingle.

Figure 5H:
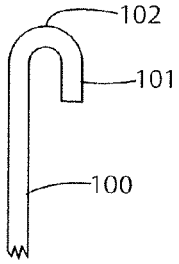

In FIG. 5H, an alternative upper end of the snow guard 100 is shown, in which the hook portion 101 thereof is arcuately bent as shown at 102, to facilitate greater flexibility in bending a snow guard as shown in FIG. 5B, to have a hook portion thereof formed in the field from an otherwise straight base snow guard as shown in FIG. 5B, rather than having the hook formed at a site of snow guard manufacture.

Figure 5I:
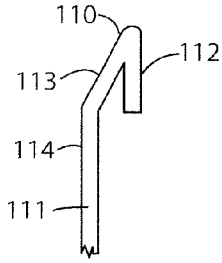

In FIG. 5I, yet another alternative upper end 110 of a snow guard 111 is shown, whereby its hook 112 is formed by first bending a portion 113 of the upper end at an angle to the left surface 114 of the snow guard of FIG. 5I, whereby the angled portion 113 can more readily enable retrofitting an installation of previously applied synthetic slates or tiles on a roof, whereby the angled portion 113 can more readily slide under the next-overlying tab of a shingle. Preferably, the embodiment of FIG. 5I would be used with a shingle having a hollowed or ribbed undersurface, to be readily slid beneath the same, preferably within a track thereof, for example, between ribs of a hollowed-out structure, as will be addressed hereinafter with respect to FIG. 6. The sloped portion 113, with the downwardly bent hook 112 encourages a spring-loaded lock during installation and reduces or eliminates the marring of surfaces of the shingle over or under which the snow guard is applied, minimizing the likelihood of damage due to scraping of a portion of the snow guard thereagainst.

Any of the snow guards of FIGS. 5D, 5E, 5F, 5G and 5I can have their upper ends arcuately bent like the bend 102 shown in FIG. 5H. Also, the hook portion 101 of the snow guard of FIG. 5H could be tapered or configured like any of the hook portions of any of the snow guards of FIGS. 5D, 5E, 5F,5G, and 5I. The bending of any of the snow guards to form hooks can occur at any time, including during manufacture of the snow guard in a manufacturing installation or on site of installation of the snow guards on a roof. Also, the bending can, on some occasions, occur on site to reflect a bend that is dependent upon the height of the shingle between its upper and lower edges, especially in the situation of previously-installed shingles, where the bending would normally occur in the field, or at the site of application of the snow guards on a roof.

With reference now to FIG. 6, it will be seen that a shingle 28 is applied to a roof base 21, as described above, but wherein the shingle 28 has a plurality of tracks 115 in its lower surface, which tracks are formed by generally vertically disposed ribs 116 that form stand-offs between one or more underlying surfaces 120, 121 (such as the underlying shingles 122, 123) and the undersurface of the shingle 28. By inserting the bases of the snow guards 40 in this manner, in tracks 115 after the shingles have been installed on a roof, and beneath the tab portions of shingles 28 that are flexibly bent outwardly within their elastic limits, the tracks 115 with their ribs 116, form a guiding medium for sliding the bases 55 of snow guards upwardly from a lower edge of an overlying shingle, up over the upper edge of a next-underlying shingle, for facilitating engagement of the hook (not shown) of the snow guard 40 shown in FIG. 6 behind the rear surface of the butt portion of a next-underlying shingle.

In a case where all shingles 28 are of the same dimension, snow guards may be centered under the overlying course or over or within the gap between adjacent shingles of the underlying course. If the width of shingles varies then the "tracks" could help in placement of the snow guards. In a case where all shingles are the same size, tracks guide the snow guards between adjacent shingles of an underlying course, as does the gap between the shingles of the underlying course. When varying widths of shingles are employed, tracks formed from ribs of a hollowed-out structure act as guides or installation tracks to assist in placement of the snow guards. The tracks can also assist in reducing lateral movement of installed snow guards.

It will be apparent for the foregoing that various modifications may be made in the details of construction as well as in the use and operation of the components of this invention, all within the spirit and scope of the invention as defined in the appended claims.

What is claimed is:

1. A roof structure comprising:

(a) a roof base of predetermined slope, adapted to receive shingles thereon, fastened thereto;

(b) a plurality of synthetic shingles of thermoplastic materials having upper and lower surfaces, with their lower surfaces fastened to the roof base in a plurality of shingle courses, with shingles in each course being laid side-by-side, with the shingles each having butt portions and tab portions and having their butt portions fastened to the roof base by fasteners, with shingles in underlying courses having exposed tab portions, with shingles in next-overlying courses having their tab portions substantially covering butt portions of shingles in next-underlying courses, and wherein each shingle has upper, lower, right and left edges;

(c) each shingle being substantially rigid while being sufficiently resiliently flexible within its elastic limit whereby tab portions of shingles may be flexibly bent upwardly an amount within their elastic limit to permit insertion of snow guards under tab portions of shingles;

(d) snow guards inserted under tab portions of shingles;

(e) said snow guards each having:

(i) a snow-engaging platform portion normally protruding outwardly beyond the shingled roof in the installed condition on a roof, below a lower edge of a shingle in a given over-lying course;

(ii) a hook engaged behind an upper edge of at least one shingle in a next-underlying course to the course of (i) above;

(iii) a base connecting the snow-engaging portion and hook, disposed beneath the shingle in the given overlying course of (i) above and above the at least one shingle in the next-underlying course of (ii) above (f) wherein the resilient flexibility of each shingle comprises means within the elastic limit of the shingle sufficient to permit the lower edge of the shingle to be bent upwardly an amount to permit insertion of the outwardly protruding platform portion of the snow guard beneath the tab portion of the shingle; and (g) wherein the bases of the snow guards extend between right and left edges of portions of adjacent shingles, comprising means whereby said adjacent shingles inhibit lateral movement of installed snow guards.

2. The roof structure of claim 1, wherein the platform portion of each snow guard is disposed directly below and adjacent a lower edge of a shingle that overlies the snow guard base.

3. The roof structure of claim 1, wherein the hooks are each in engagement with upper edges of two adjacent shingles.

4. The roof structure of claim 1, wherein the hook of each snow guard has an outwardly beveled edge.

5. The roof structure of claim 1, wherein the hook of each snow guard has an inwardly beveled edge.

6. The roof structure of claim 1, wherein the hook of each snow guard is arcuately rounded.

7. The roof structure of claim 1, wherein the base of each snow guard has an upper end opposite the hook that is disposed at an angle to the base.

8. The roof structure of claim 1, wherein the hook is in spring-like frictional engagement behind at least one shingle in said next-underlying course.

9. The roof structure of claim 1, wherein the snow guards have downwardly facing protuberances extending between spaced apart opposing edges of tab portions of underlying shingles, comprising supplementary means inhibiting lateral movement leftward and rightward of installed snow guards.

10. The structure of claim 1, wherein the platform portion of each snow guard is disposed directly below and adjacent a lower edge of a shingle that overlies the snow guard base, wherein the hooks are each in engagement with upper edges of two adjacent shingles, wherein the hook of each snow guard is arcuately rounded, wherein the base of each snow guard has an upper end opposite the hook that is disposed at an angle to the base, wherein the hook is in spring-like frictional engagement behind at least one shingle in said next-underlying course, and wherein the snow guards have downwardly facing protuberances extending between spaced apart opposing edges of tab portions of underlying shingles, comprising supplementary means inhibiting lateral movement leftward and rightward of installed snow guards.

11. A roof structure comprising:

(a) a roof base of predetermined slope, adapted to receive shingles thereon, fastened thereto;

(b) a plurality of synthetic shingles of thermoplastic materials having upper and lower surfaces, with their lower surfaces fastened to the roof base in a plurality of shingle courses, with shingles in each course being laid side-by-side, with the shingles each having butt portions and tab portions and having their butt portions fastened to the roof base by fasteners, with shingles in underlying courses having exposed tab portions, with shingles in next-overlying courses having their tab portions substantially covering butt portions of shingles in next-underlying courses, and wherein each shingle has upper, lower, right and left edges;

(c) each shingle being substantially rigid while being sufficiently resiliently flexible within its elastic limit whereby tab portions of shingles may be flexibly bent upwardly an amount within their elastic limit to permit insertion of snow guards under tab portions of shingles;

(d) snow guards inserted under tab portions of shingles;

(e) said snow guards each having:

(i) a snow-engaging platform portion normally protruding outwardly beyond the shingled roof in the installed condition on a roof, below a lower edge of a shingle in a given over-lying course;

(ii) a hook engaged behind an upper edge of at least one shingle in a next-underlying course to the course of (i) above;

(iii) a base connecting the snow-engaging portion and hook, disposed beneath the shingle in the given overlying course of (i) above and above the at least one shingle in the next-underlying course of (ii) above (f) wherein the resilient flexibility of each shingle comprises means within the elastic limit of the shingle sufficient to permit the lower edge of the shingle to be bent upwardly an amount to permit insertion of the outwardly protruding platform portion of the snow guard beneath the tab portion of the shingle; and (g) wherein shingles on the roof base have at least one recessed track in their lower surfaces between upper and lower shingle edges, and with bases of snow guards disposed in said tracks, comprising means facilitating guiding installation of snow guards in the said tracks behind installed shingles, with said tracks comprising means inhibiting lateral movement of snow guards relative to overlying shingles.

12. The roof structure of claim 11, wherein the platform portion of each snow guard is disposed directly below and adjacent a lower edge of a shingle that overlies the snow guard base.

13. The roof structure of claim 11, wherein the hooks are each in engagement with upper edges of two adjacent shingles.

14. The roof structure of claim 11, wherein the hook of each snow guard has an outwardly beveled edge.

15. The roof structure of claim 11, wherein the hook of each snow guard has an inwardly beveled edge.

16. The roof structure of claim 11, wherein the hook of each snow guard is arcuately rounded.

17. The roof structure of claim 11, wherein the base of each snow guard has an upper end opposite the hook that is disposed at an angle to the base.

18. The roof structure of claim 11, wherein the hook is in spring-like frictional engagement behind at least one shingle in said next-underlying course.

19. The roof structure of claim 11, wherein the snow guards have downwardly facing protuberances extending between spaced apart opposing edges of tab portions of underlying shingles, comprising supplementary means inhibiting lateral movement leftward and rightward of installed snow guards.

20. The roof structure of claim 11, wherein the platform portion of each snow guard is disposed directly below and adjacent a lower edge of a shingle that overlies the snow guard base, wherein the hooks are each in engagement with upper edges of two adjacent shingles, wherein the hook of each snow guard is arcuately rounded, wherein the base of each snow guard has an upper end opposite the hook that is disposed at an angle to the base, wherein the hook is in spring-like frictional engagement behind at least one shingle in said next-underlying course and wherein the snow guards have downwardly facing protuberances extending between spaced apart opposing edges of tab portions of underlying shingles, comprising supplementary means inhibiting lateral movement leftward and rightward of installed snow guards.

* * * * *